US008035476B2

(12) United States Patent
Yang et al.

(10) Patent No.: US 8,035,476 B2
(45) Date of Patent: Oct. 11, 2011

(54) CHIP RESISTOR AND METHOD FOR MAKING THE SAME

(75) Inventors: Chih-Chung Yang, Kaohsiung (TW); Wen-Fon Wu, Kaohsiung (TW); Mei-Ling Lin, Kaohsiung (TW); Wen-Cheng Wu, Kaohsiung (TW); Tsai-Hu Chen, Kaohsiung (TW); Wen-Hsing Kong, Kaohsiung (TW)

(73) Assignee: Yageo Corporation, Kaohsiung (TW)

( * ) Notice: Subject to any disclaimer, the term of this patent is extended or adjusted under 35 U.S.C. 154(b) by 341 days.

(21) Appl. No.: 12/429,081

(22) Filed: Apr. 23, 2009

(65) Prior Publication Data

US 2010/0201477 A1 Aug. 12, 2010

(30) Foreign Application Priority Data

Feb. 6, 2009 (TW) ..... 98103896 A

(51) Int. Cl.
*H01C 1/12* (2006.01)

(52) U.S. Cl. ..... 338/309; 338/313; 338/332

(58) Field of Classification Search ..... 338/307, 338/308, 309, 313, 329, 332
See application file for complete search history.

(56) References Cited

U.S. PATENT DOCUMENTS

| | | | | |
|---|---|---|---|---|
| 6,356,184 | B1 * | 3/2002 | Doi et al. | 338/309 |
| 2010/0201477 | A1 * | 8/2010 | Yang et al. | 338/309 |
| 2011/0089025 | A1 * | 4/2011 | Yang et al. | 204/192.21 |

OTHER PUBLICATIONS

Chinese Office Action dated May 6, 2011 for 200910127171.X, which is a corresponding Chinese application, which was received on May 12, 2011.

* cited by examiner

*Primary Examiner* — James Harvey
(74) *Attorney, Agent, or Firm* — WPAT, P.C.; Anthony King

(57) ABSTRACT

The present invention relates to a chip resistor and method for making the same. The chip resistor includes a substrate, a pair of bottom electrodes, a resistive film, a pair of main upper electrodes, a first protective coat, a pair of barrier layers, a second protective coat, a pair of side electrodes and at least one plated layer. The first protective coat is disposed over the resistive film, and covers part of the main upper electrodes. The barrier layers are disposed on the main upper electrodes, and cover part of the first protective coat. The second protective coat is disposed on the first protective coat, and covers part of the barrier layers. The plated layers cover the barrier layers, the bottom electrodes and the side electrodes. As a result, the chip resistor features high corrosion resistance.

21 Claims, 9 Drawing Sheets

CHIP RESISTOR AND METHOD FOR MAKING THE SAME

BACKGROUND OF THE INVENTION

1. Field of the Invention

The present invention relates to a chip resistor and a method for making the same, and particularly to a chip resistor having barrier layers and a method for making the same.

2. Description of the Related Art

FIG. 1 shows a schematic cross-sectional view of a conventional chip resistor. The chip resistor 1 is a passive device soldered on an integrated circuit board, and is used for providing resistance. The chip resistor 1 includes a substrate 11, a pair of main upper electrodes 12, a pair of bottom electrodes 13, a resistive film 14, a first protective coat 15, a second protective coat 16, a pair of side electrodes 17, a pair of first plated layers 18, and a pair of second plated layers 19.

The substrate 11 is made of an insulating material, an approximately rectangular plate, and has a back face 111, a pair of side faces 112, and a main face 113. The side faces 112 respectively extend upwards from two opposite sides of the back face 111. The main face 113 corresponds to the back face 111. The main upper electrodes 12 are conductively disposed on the main face 113 of the substrate 11, and are separate from each other. Each main upper electrode 12 has an inner side face 121, an outer side face 122, and an inner end portion 123. The outer side face 122 of the main upper electrode 12 is aligned with the side face 112 of the substrate 11.

The bottom electrodes 13 are conductively disposed on the back face 111 of the substrate 11, and are separate from each other. Each bottom electrode 13 has an outer side face 132. The outer side face 132 of the bottom electrode 13 is aligned with the side face 112 of the substrate 11, such that the main upper electrodes 12 and the bottom electrodes 13 are symmetrical to each other.

The resistive film 14 has a predetermined resistance and is disposed on the main face 113 of the substrate 11, and is disposed in a region between the inner side faces 121 of the main upper electrodes 12. The resistive film 14 extends over the main upper electrodes 12, such that two end portions of the resistive film 14 overlap with the inner end portions 123 of the main upper electrodes 12. The first protective coat 15 is made of a cuttable insulating material, and covers the resistive film 14, such that the resistive film 14 is isolated from the outside environment. The second protective coat 16 is made of an insulating material, and covers the first protective coat 15 and part of the main upper electrodes 12, such that the resistive film 14 and the first protective coat 15 are isolated from the outside environment.

The side electrodes 17 are made of a conductive material. Each side electrode 17 is formed on the side face 112 of the substrate 11, the outer side face 122 of the main upper electrode 12, and the outer side face 132 of the bottom electrode 13, for electrically connecting the main upper electrode 12 and the bottom electrode 13. The first plated layers 18 are nickel layers, and each first plated layer 18 covers the main upper electrode 12, the bottom electrode 13, and the side electrode 17. The second plated layers 19 are tin layers, and each second plated layer 19 covers the first plated layer 18. The second plated layers 19 and the first plated layers 18 are formed by electroplating.

The disadvantage of the conventional chip resistor 1 is described as follows. In an environment with high sour gas and high corrosive gas, the corrosion gas easily penetrates the chip resistor 1 through the interfaces between the second protective coat 16 and the first plated layer 18 and between the second protective coat 16 and the second plated layer 19, and chemically reacts with silver or copper in the main upper electrode 12 to generate silver sulfide or copper sulfide, thus changing the resistance value. More seriously, an open-circuit may be formed, which will paralyze the system where the chip resistor 1 is located.

Therefore, it is necessary to create a chip resistor that solves the above problem and a method of making the same.

SUMMARY OF THE INVENTION

The present invention provides a method for making the chip resistor, comprising the following steps: (a) providing a substrate having a back face, two side faces, and a main face; (b) forming a pair of bottom electrodes on the back face of the substrate, wherein the bottom electrodes are separate from each other, and each bottom electrode has an outer side face; (c) forming a resistive film on a middle region of the main face of the substrate; (d) forming a pair of main upper electrodes on the main face of the substrate, wherein the main upper electrodes are separate from each other, and each main upper electrode has an outer side face; (e) forming a first protective coat over the resistive film, wherein the first protective coat covers part of the main upper electrodes; (f) forming two barrier layers on the main upper electrodes, wherein the barrier layers cover part of the first protective coat; (g) forming a second protective coat on the first protective coat, wherein the second protective coat covers part of the barrier layers; (h) forming a pair of side electrodes, wherein each side electrode is disposed on the side face of the substrate, the outer side face of the main upper electrode, an outer side face of the barrier layer, and the outer side face of the bottom electrode, for being electrically connected to the main upper electrode, the barrier layer, and the bottom electrode; and (i) forming at least one plated layer, for covering the barrier layers, the bottom electrodes, and the side electrode, thereby forming a chip resistor.

The present invention further provides a chip resistor that comprises a substrate, a pair of bottom electrodes, a resistive film, a pair of main upper electrodes, a first protective coat, a pair of barrier layers, a second protective coat, a pair of side electrodes, and at least one plated layer. The substrate has a back face, two side faces, and a main face. The bottom electrodes are disposed on the back face of the substrate and separate from each other. Each bottom electrode has an outer side face. The resistive film is disposed on the main face of the substrate. The main upper electrodes are disposed on the main face of the substrate and separate from each other. Each main upper electrode has an outer side face. The first protective coat is disposed over the resistive film, and covers a part of the main upper electrodes. The barrier layers are disposed on the main upper electrodes, and cover part of the first protective coat. The second protective coat is disposed on the first protective coat, and covers part of the barrier layers. Each side electrode is disposed on the side face of the substrate, the outer side face of the main upper electrode, an outer side face of the barrier layer, and the outer side face of the bottom electrode, for electrically connecting the main upper electrode, the barrier layer, and the bottom electrode. The plated layer(s) cover(s) the barrier layers, the bottom electrodes, and the side electrodes.

The barrier layers have the capabilities of anti-sulfuration and anti-corrosion, which can effectively protect the main upper electrodes from sour gas or other corrosive gases, thus overcoming the disadvantages of the conventional art that the chip resistor is easily affected by the outside environment, resulting in changed resistance value, or even an open-circuit and paralyzed system. In addition, in the manufacturing process of the present invention, the first protective coat is formed before the barrier layers are formed, then, the second protective coat is formed, and finally the plated layers are formed. Therefore, the corrosive gas in the environment cannot directly penetrate the main upper electrodes through the interface between the second protective coat and the plated layer.

DETAILED DESCRIPTION OF THE INVENTION

Figure 1:
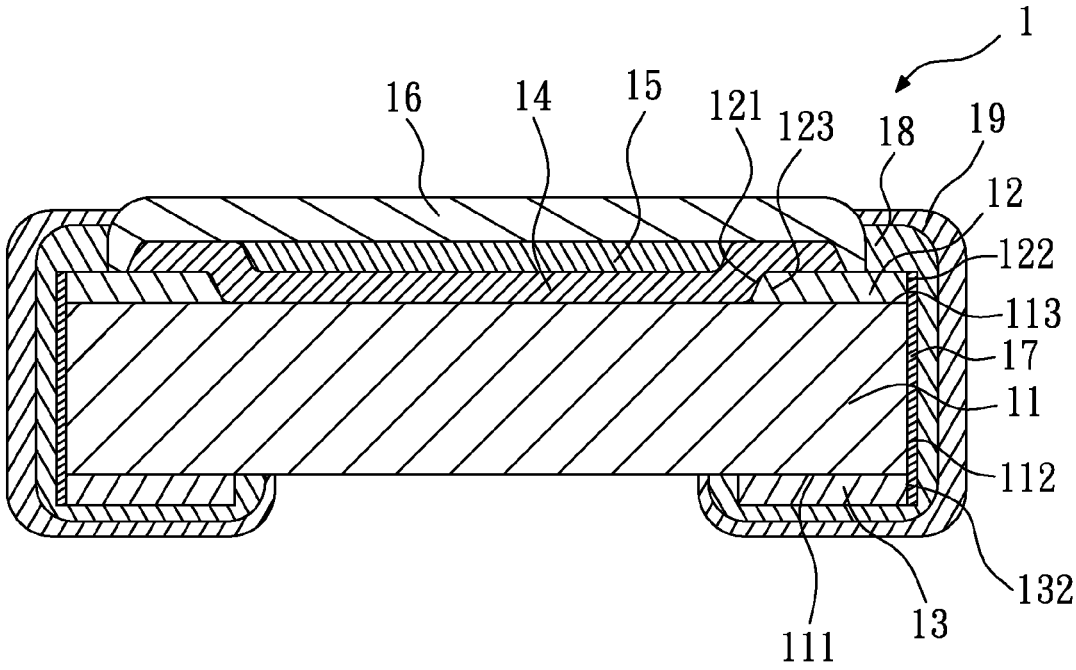
FIG. 1 (Prior Art)
FIG. 1 is a schematic cross-sectional view of a conventional chip resistor.
Figure 2:
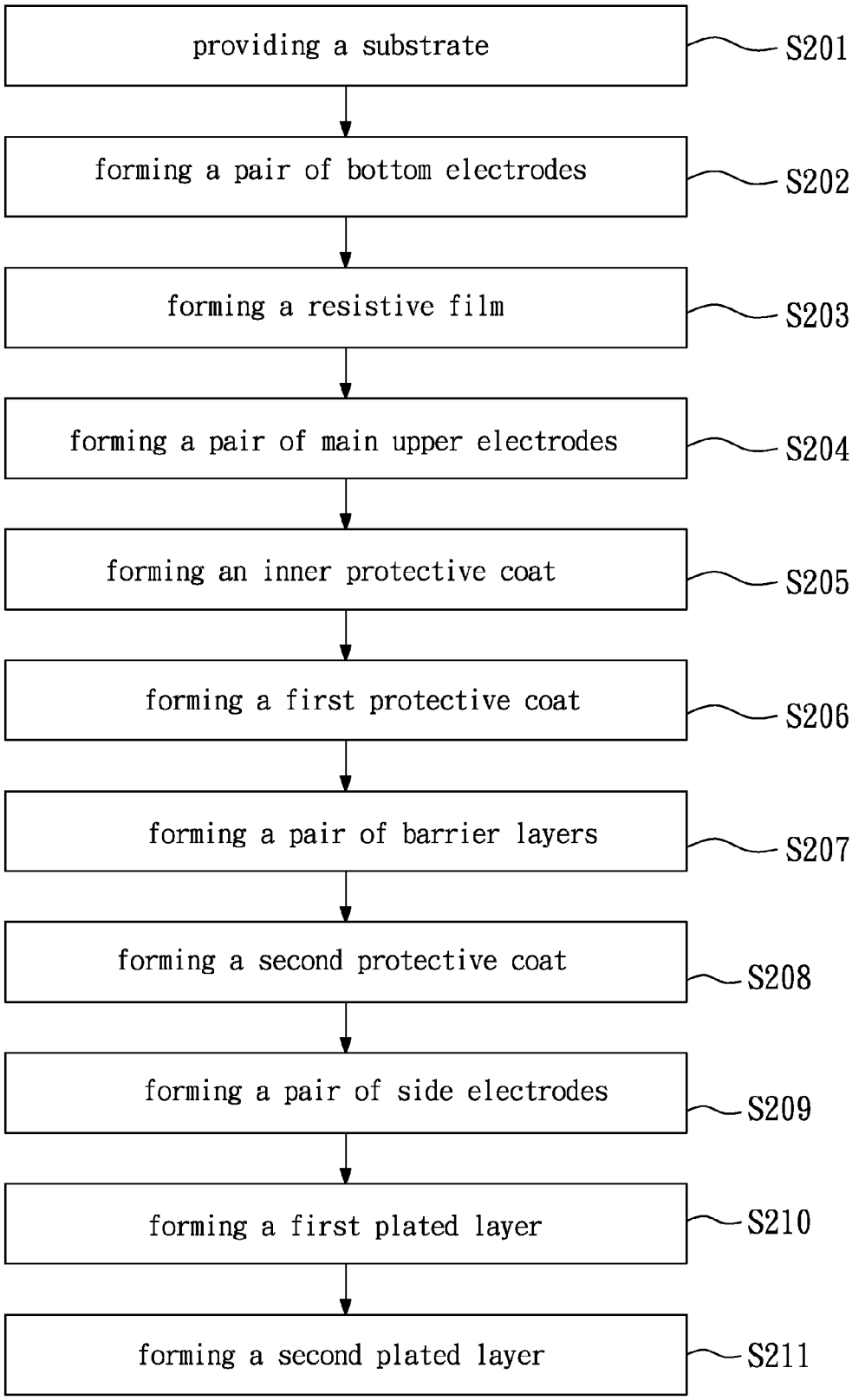
FIG. 2 is a schematic flow chart of a method for making a chip resistor according to the first embodiment of the present invention.

FIG. 2 shows a schematic flow chart of a method for making a chip resistor according to the first embodiment of the present invention. FIGS. 3*a* to 3*k* show schematic cross-sectional views of each step of the method for making the chip resistor according to the first embodiment of the present invention. In this embodiment, a thick film chip resistor is shown.

Figure 3A:
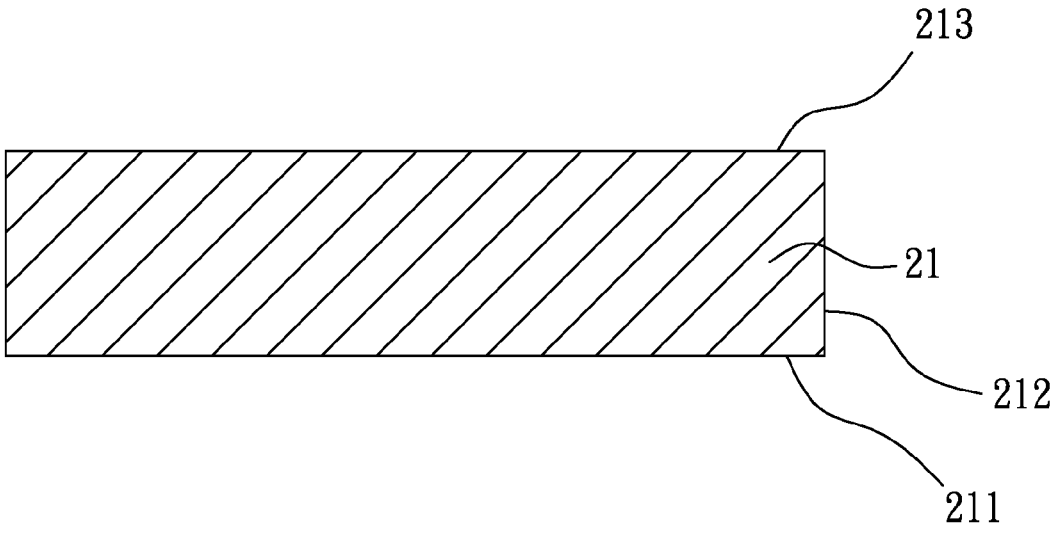
FIGS. 3*a* to 3*k* are schematic cross-sectional views of each step of the method for making the chip resistor according to the first embodiment of the present invention.

Referring to FIGS. 2 and 3*a*, in Step S201, a substrate 21 is provided, in which the substrate 21 has a back face 211, two side faces 212, and a main face 213.

Figure 3B:
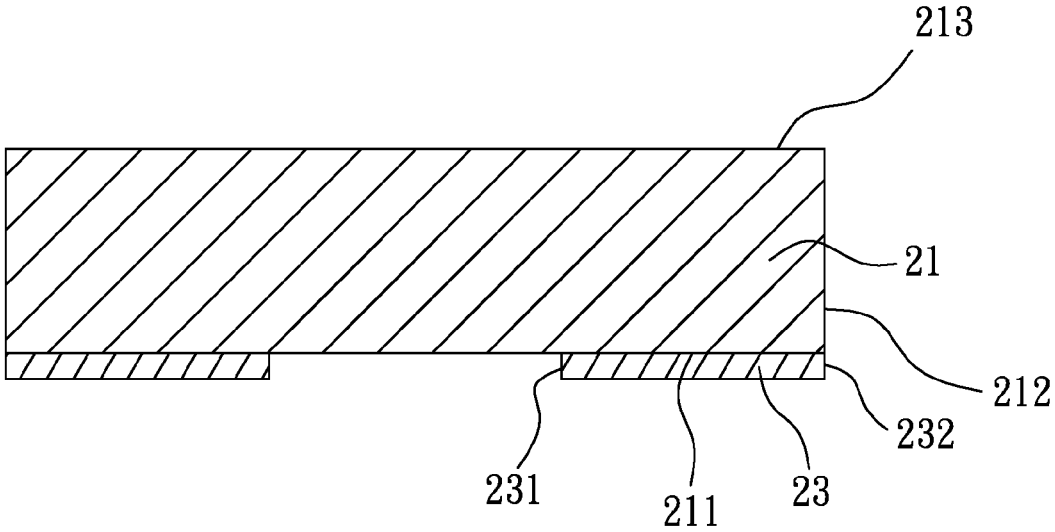

Referring to FIGS. 2 and 3*b*, in Step S202, a pair of bottom electrodes 23 is formed on the back face 211 of the substrate 21. The bottom electrodes 23 are separate from each other and are not connected to each other. Each bottom electrode 23 has an inner side face 231 and an outer side face 232. In the specification of the present invention, "inner side" refers to a direction toward a middle region of the substrate 21, and "outer side" refers to a direction away from the middle region of the substrate 21. In this embodiment, the bottom electrodes 23 are formed by printing.

Figure 3C:
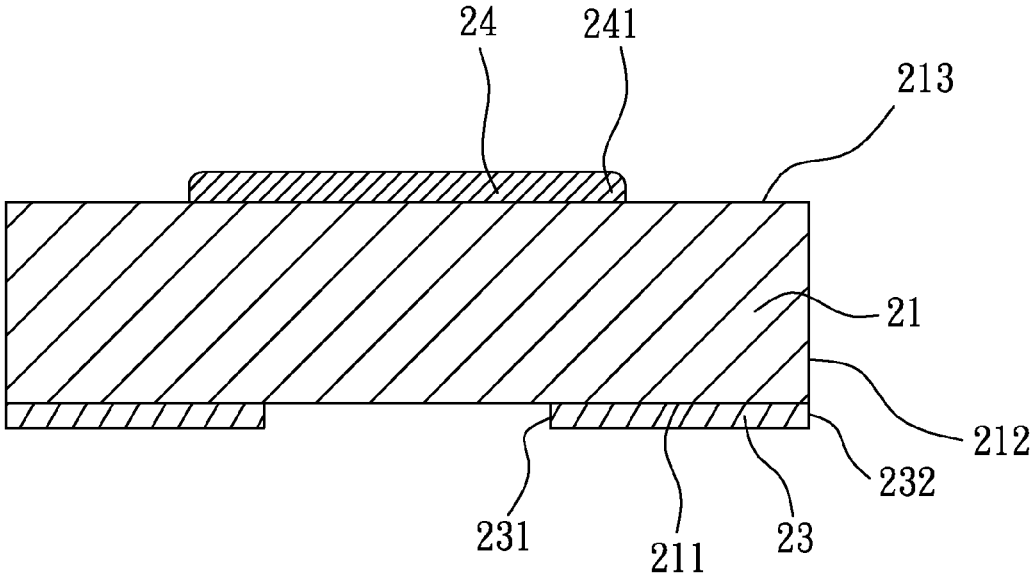

Referring to FIGS. 2 and 3*c*, in Step S203, a resistive film 24 is formed on the middle region of the main face 23 of the substrate 21, and the resistive film 24 has two end portions 241. In this embodiment, the resistive film 24 is formed by printing, and a material thereof could be ruthenium, copper, silver, palladium, or other conductive printing ink.

Figure 3D:
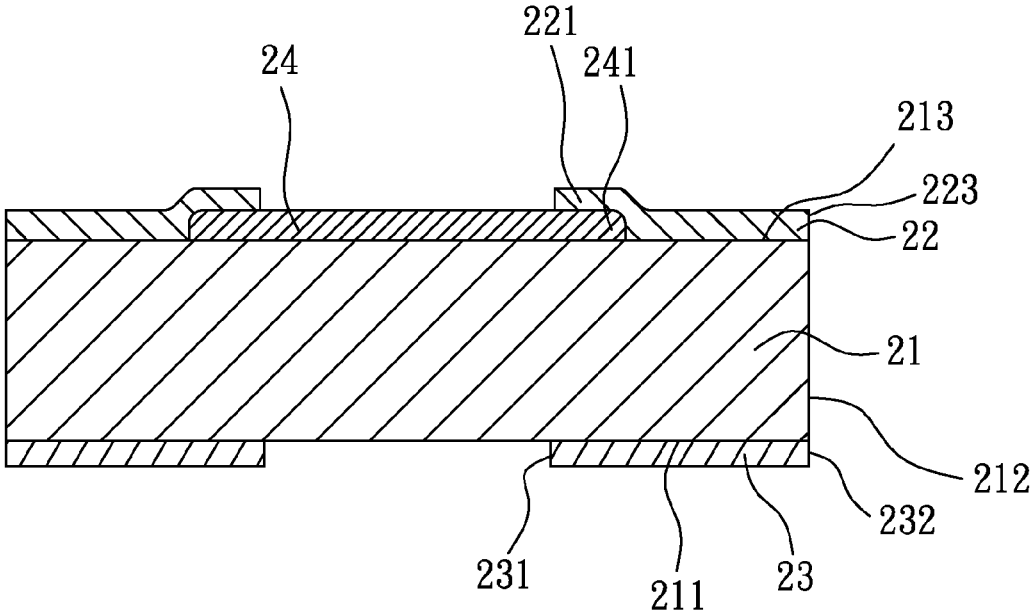

Referring to FIGS. 2 and 3*d*, in Step S204, a pair of main upper electrodes 22 are formed on the main face 213 of the substrate 21, and the main upper electrodes 22 are separate from each other and are not connected to each other. Each main upper electrode 22 has an inner end portion 221 and an outer side face 223. The main upper electrode 22 extends onto the resistive film 24, such that the inner end portion 221 of the main upper electrode 22 overlaps the end portion 241 of the resistive film 24. In this embodiment, the main upper electrodes 22 are formed by printing.

Figure 3E:
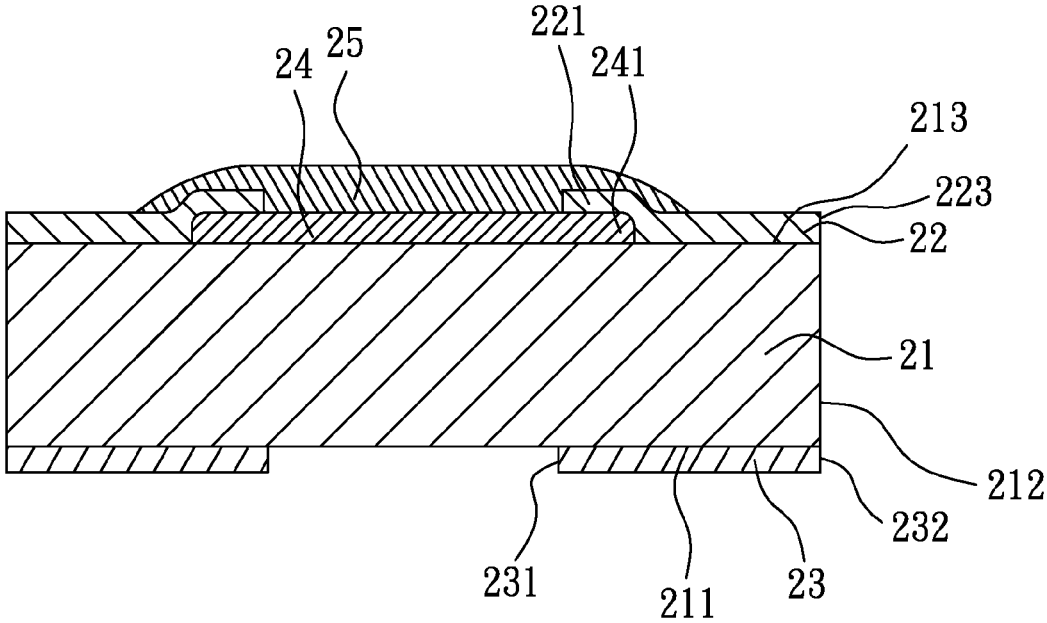

Referring to FIGS. 2 and 3*e*, in Step S205, an inner protective coat 25 is formed on the resistive film 24, and the inner protective coat 25 further covers part of the main upper electrodes 22. That is, the inner protective coat 25 is in contact with the main upper electrodes 22. In this embodiment, a material of the inner protective coat 25 is glass. Preferably, after Step S205, the method further includes a step of accurately cutting the resistive film 24 with a high-energy laser beam to modulate its resistance value.

Figure 3F:
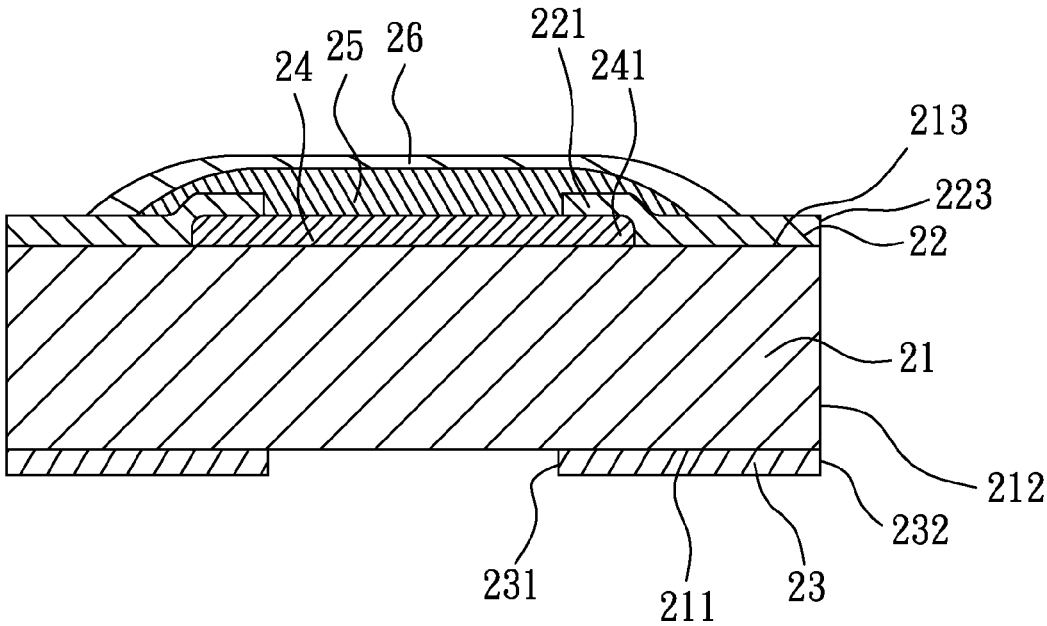

Referring to FIGS. 2 and 3*f*, in Step S206, a first protective coat 26 is formed over the resistive film 24, and the first protective coat 26 covers part of the main upper electrodes 22. That is, the first protective coat 26 is in contact with the main upper electrodes 22. The thick film chip resistor shown in this embodiment is further provided with the inner protective coat 25, and thus the first protective coat 26 covers the inner protective coat 25.

Figure 3G:
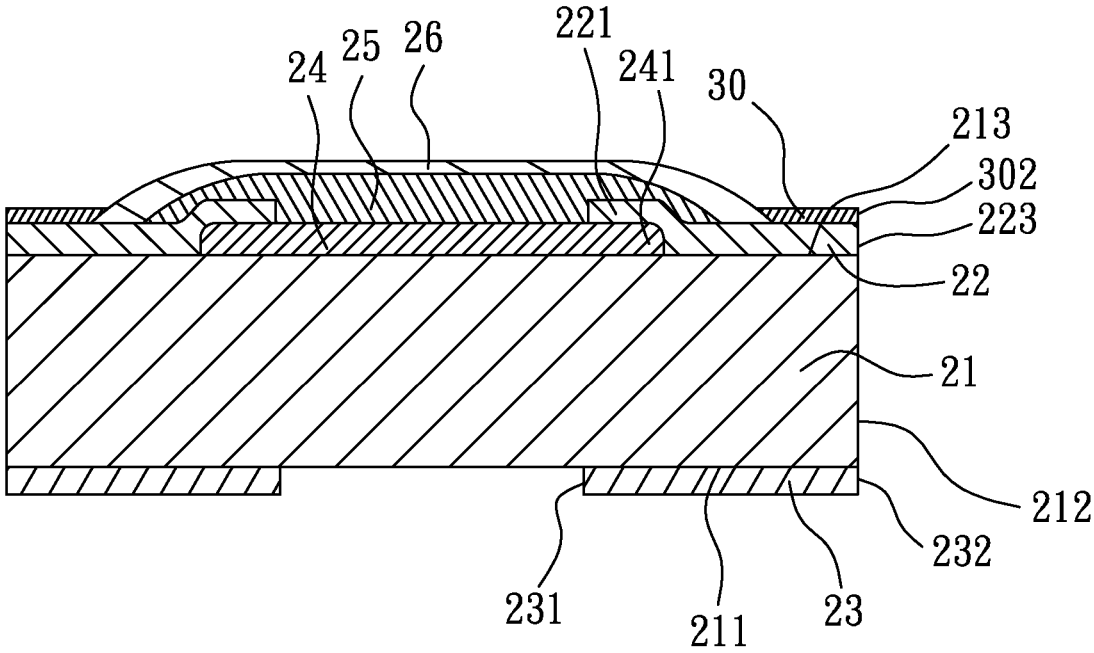

Referring to FIGS. 2 and 3*g*, in Step S207, a pair of barrier layers 30 are formed on the main upper electrode 22, and each barrier layer 30 has an outer side face 302. Preferably, each barrier layer 30 totally covers a wide edge of each main upper electrode 22, such that the barrier layers 30 are in contact with the main face 213 of the substrate 21. The barrier layers 30 are in contact with the first protective coat 26, and cover or overlap with the two ends of the first protective coat 26. The barrier layers 30 may be made of conductive material, which is preferably selected from a group consisting of nickel, palladium, platinum, gold, nickel-chromium, nickel-boron, nickel-phosphor, and a combination thereof. In this embodiment, the barrier layers 30 are formed by electroplating, and the material thereof is nickel.

Figure 3H:
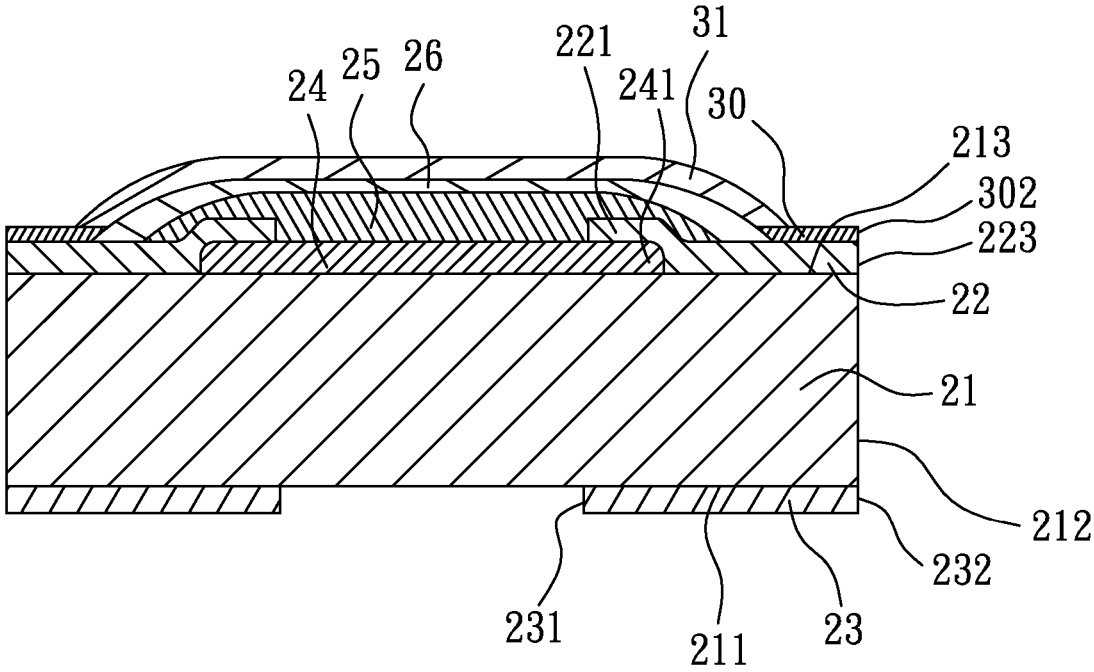

Referring to FIGS. 2 and 3*h*, in Step S208, a second protective coat 31 is formed on the first protective coat 26, and the second protective coat 31 covers part of the barrier layers 30. That is, the second protective coat 31 is in contact with the barrier layers 30, but is not in contact with the main upper electrodes 22. It should be understood that the second protective coat 31 covers the main face 213 of the substrate 21. The material of the second protective coat 31 may be the same as or different from the material of the first protective coat 26. If the materials are the same, an interface between the second protective coat 31 and the first protective coat 26 will not be distinct, and there appears to be only one layer.

Figure 3I:
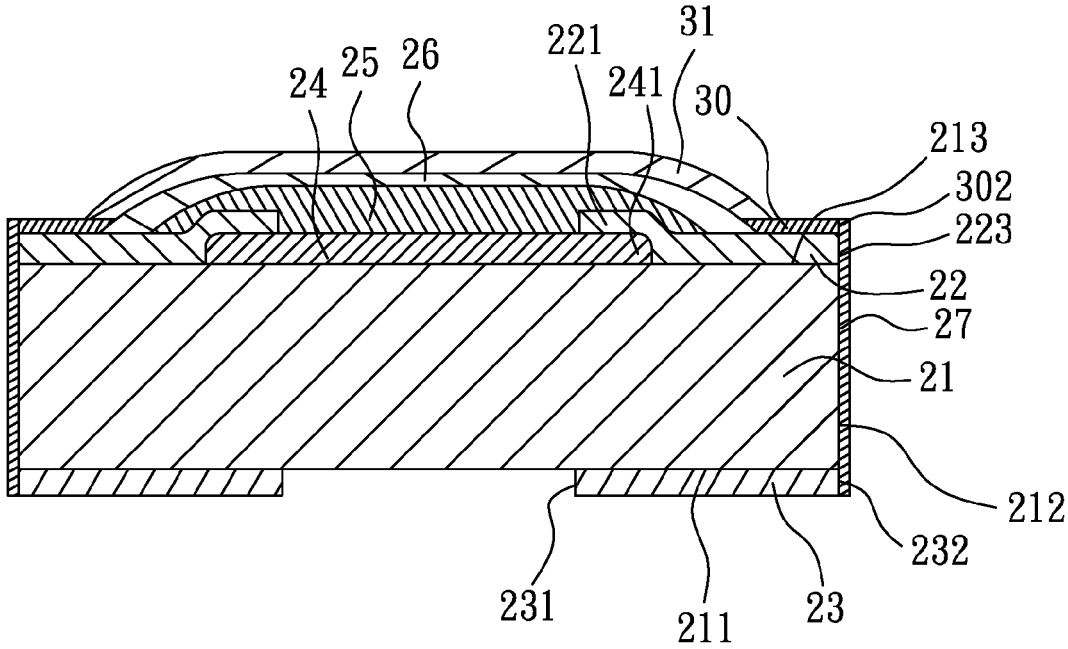

Referring to FIGS. 2 and 3*i*, in Step S209, a pair of side electrodes 27 are formed. Each side electrode 27 is formed on the side face 212 of the substrate 21, the outer side face 223 of the main upper electrode 22, the outer side face 232 of the bottom electrode 23, and the outer side face 302 of the barrier layer 30, for electrically connecting the main upper electrode 22, the barrier layer 30, and the bottom electrode 23. The side electrodes 27 may be formed by coating or vacuum sputtering.

Figure 3J:
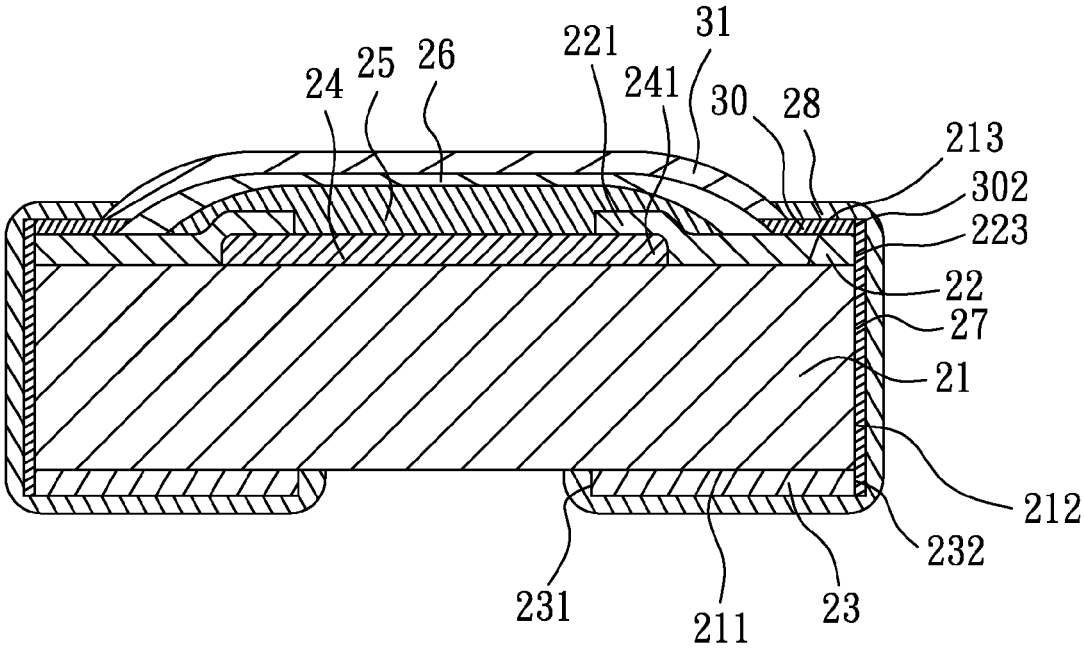
Figure 3K:
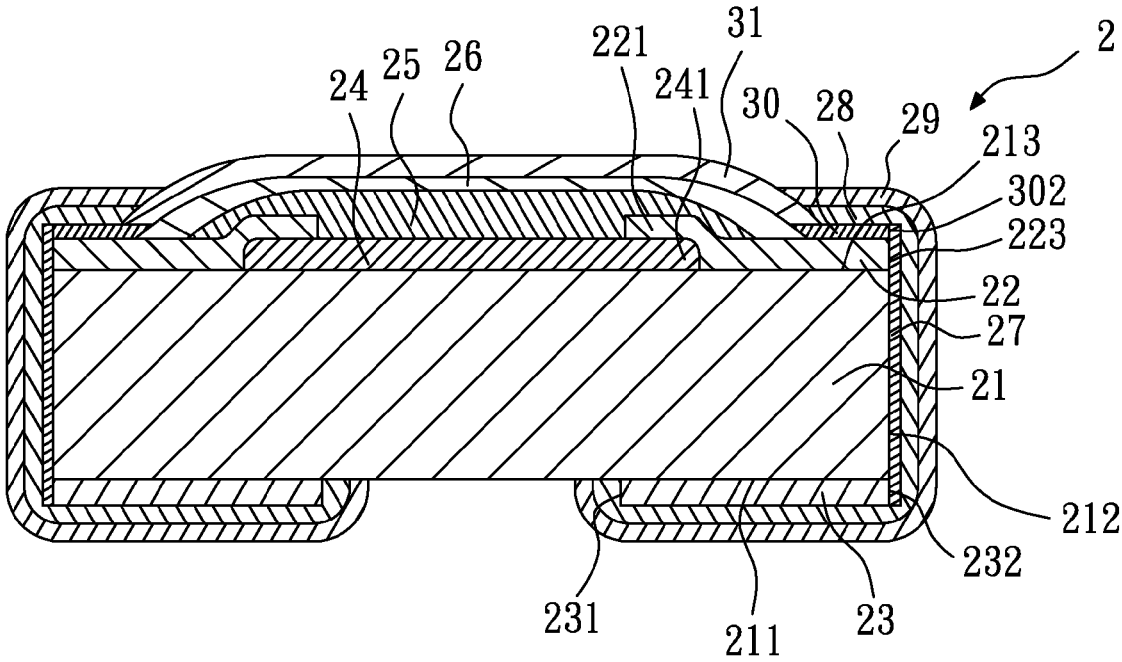

Referring to FIGS. 2, 3*j*, and 3*k*, then, at least one plated layer is formed to cover the barrier layers 30, the bottom electrodes 23, and the side electrodes 27, so as to form a chip resistor 2. In other applications, if the area of each barrier layer 30 is smaller than that of each main upper electrode 22, the plated layer further covers the main upper electrodes 22. In this embodiment, there should be one to two plated layers. In Step S210, a first plated layer 28 is formed to cover the barrier layers 30, the bottom electrodes 23, and the side electrodes 27, as shown in FIG. 3*j*. In other applications, if the barrier layers 30 do not totally cover an upper surface of each main upper electrode 22 (that is, the width of the barrier layer 30 is smaller than the width of the main upper electrode 22), a part of the main upper electrode 22 will be exposed, and meanwhile, the first plated layer 28 further will cover the exposed main upper electrodes 22. In this embodiment, the material of the first plated layer 28 is nickel, which is the same as that of the barrier layers 30, such that the interface between the first plated layer 28 and the barrier layer 30 is not distinct, and there appears to be only one layer.

In Step S211, a second plated layer 29 is formed to cover the first plated layer 28, as shown in FIG. 3*k*. In this embodiment, the material of the second plated layer 29 is tin.

Referring to FIG. 3*k* again, a schematic cross-sectional view of the chip resistor according to the first embodiment of the present invention is shown. The chip resistor 2 is a thick film chip resistor, which comprises a substrate 21, a pair of bottom electrodes 23, a resistive film 24, a pair of main upper electrodes 22, an inner protective coat 25, a first protective coat 26, a pair of barrier layers 30, a second protective coat 31, a pair of side electrodes 27, and at least one plated layer.

The substrate 21 has a back face 211, two side faces 212, and a main face 213. The bottom electrodes 23 are disposed on the back face 211 of the substrate 21 and are separate from each other, and each bottom electrode 23 has an outer side face 232. The resistive film 24 is disposed on the middle region of the main face 213 of the substrate 21, and the resistive film 24 has two end portions 241. In this embodiment, the material of the resistive film 24 can be, for example, ruthenium, copper, silver, palladium, or conductive printing ink.

The main upper electrodes 22 are disposed on the main face 213 of the substrate 21 and separate from each other. Each main upper electrode 22 has an inner end portion 221 and an outer side face 223. In this embodiment, the main upper electrode 22 extends onto the resistive film 24, such that the inner end portion 221 of the main upper electrode 22 overlaps with the end portion 241 of the resistive film 24.

The inner protective coat 25 is disposed on the resistive film 24, and covers part of the main upper electrodes 22; that is, the inner protective coat 25 comes into contact with the main upper electrodes 22. In this embodiment, the material of the inner protective coat 25 is glass.

The first protective coat 26 is disposed over the resistive film 24, and covers part of the main upper electrodes 22; that is, the first protective coat 26 comes into contact with the main upper electrodes 22. The thick film chip resistor shown in this embodiment is further provided with the inner protective coat 25, and thus the first protective coat 26 covers the inner protective coat 25.

The barrier layers 30 are disposed on the main upper electrodes 22, and cover part of the first protective coat 26. Each barrier layer 30 has an outer side face 302. Preferably, each barrier layer 30 totally covers the wide edge of each main upper electrode 22, such that the barrier layers 30 come into contact with the main face 213 of the substrate 21. The barrier layers 30 come into contact with the first protective coat 26, and cover or overlap with the two ends of the first protective coat 26. The barrier layers 30 may be made of conductive material, which is preferably selected from a group consisting of nickel, palladium, platinum, gold, nickel-chromium, nickel-boron, nickel-phosphor and a combination thereof. In this embodiment, the barrier layers 30 are formed by electroplating, and the material thereof is nickel.

The second protective coat 31 is disposed on the first protective coat 26, and covers part of the barrier layers 30. That is, the second protective coat 31 comes into contact with the barrier layers 30, but not the main upper electrodes 22. The material of the second protective coat 31 may be the same as or different from the material of the first protective coat 26. If the materials are the same, the interface between the second protective coat 31 and the first protective coat 26 is not distinct, and there appears to be only one layer.

Each side electrode 27 is disposed on the side face 212 of the substrate 21, the outer side face 223 of the main upper electrode 22, the outer side face 232 of the bottom electrode 23, and the outer side face 302 of the barrier layer 30, for electrically connecting the main upper electrode 22, the barrier layer 30, and the bottom electrode 23.

The plated layer(s) cover(s) the barrier layers 30, the bottom electrodes 23, and the side electrodes 27. In other applications, if the area of each barrier layer 30 is smaller than that of each main upper electrode 22, the plated layer further covers the main upper electrodes 22. In this embodiment, the plated layer(s) include(s) a first plated layer 28 and a second plated layer 29. The first plated layer 28 covers the barrier layers 30, the bottom electrode 23, and the side electrode 27. In other applications, if the barrier layers 30 do not totally cover the upper surface of each main upper electrode 22 (that is, the width of the barrier layer 30 is smaller than the width of the main upper electrode 22), part of the main upper electrodes 22 will be exposed, and meanwhile, the first plated layer 28 will cover the exposed main upper electrodes 22. In this embodiment, the material of the first plated layer 28 is nickel, which is the same as the material of the barrier layers 30, such that the interface between the first plated layers 28 and the barrier layers 30 is not distinct, and there appears to be only one layer. The second plated layer 29 covers the first plated layer 28. In this embodiment, the material of the second plated layer 29 is tin.

The advantage of the present invention is that the barrier layers 30 having anti-sulfuration and anti-corrosion capabilities are added, which effectively protect the main upper electrodes 22 from being affected by sour gas or other corrosive gases, so as to overcome the disadvantage in the conventional art that the chip resistor 1 is easily affected by the outside environment, resulting in the changed resistance value, or even an open-circuit and paralyzed system. In addition, during the manufacturing process of the present invention, the first protective coat 26 is formed before the barrier layers 30 are formed, then, the second protective coat 31 is formed, and finally the plated layers (the first plated layer 28 and the second plated layer 29) are formed. Therefore, the corrosive gas in the environment cannot directly penetrate the main upper electrodes 22 through the interface between the second protective coat 31 and the first plated layer 28 and between the second protective coat 31 and the second plated layer 29.

Figure 4:
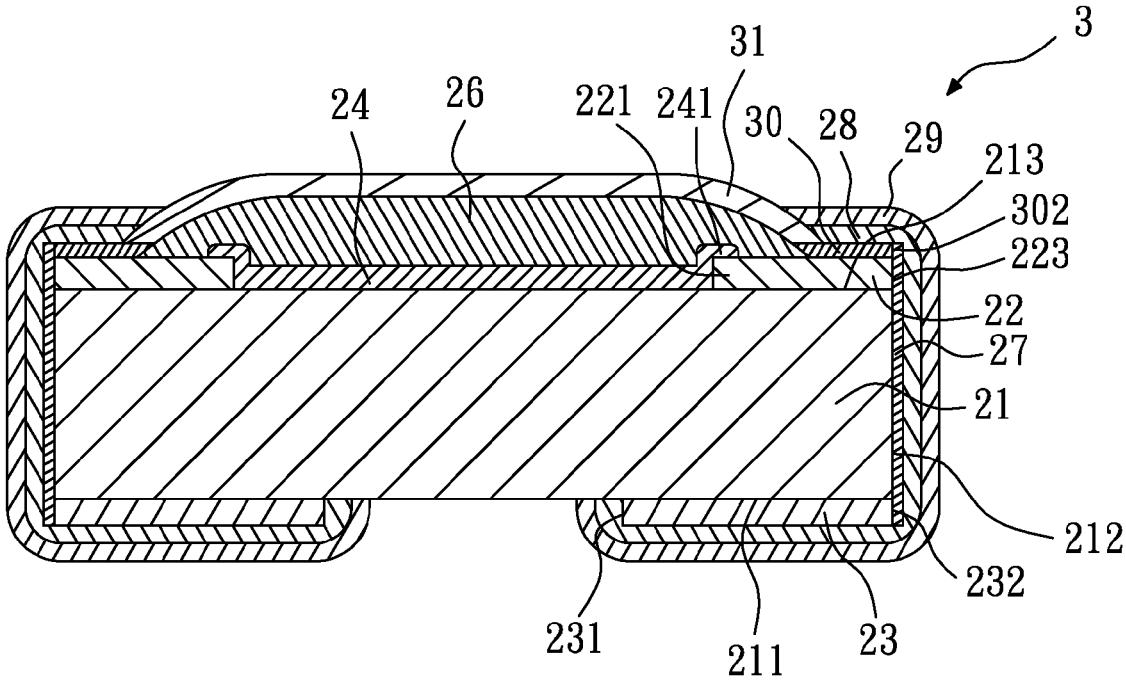
FIG. 4 is a schematic cross-sectional view of the chip resistor according to the second embodiment of the present invention.

FIG. 4 shows a schematic cross-sectional view of the chip resistor according to a second embodiment of the present invention. The chip resistor 3 is a thin film chip resistor, and is substantially the same as the chip resistor 2 (FIG. 3*k*) of the first embodiment, in which the same elements are designated with the same reference numerals. The difference between this embodiment and the first embodiment is that the chip resistor 3 of this embodiment does not have the inner protective coat 25, such that the first protective coat 26 directly covers the resistive film 24. In addition, during the manufacturing method of this embodiment, the main upper electrodes 22 are formed on the main face 213 of the substrate 21 before the resistive film 24 is formed. That is, in the flow chart of FIG. 2, after Step S202, Step S204 is performed before Step S203. Thus, the resistive film 24 extends onto the main upper electrode 22, such that the end portion 241 of the resistive film 24 overlaps with the inner end portion 221 of the main upper electrode 22.

While several embodiments of the present invention have been illustrated and described, various modifications and improvements can be made by those skilled in the art. The embodiments of the present invention are therefore described in an illustrative but not restrictive sense. It is intended that the present invention should not be limited to the particular forms as illustrated, and that all modifications which maintain the spirit and scope of the present invention are within the scope defined in the appended claims.

What is claimed is:

1. A chip resistor, comprising:

a substrate, having a back face, two side faces, and a main face;

a pair of bottom electrodes, disposed on the back face of the substrate and separate from each other, and each bottom electrode having an outer side face;

a resistive film, disposed on the main face of the substrate;

a pair of main upper electrodes, disposed on the main face of the substrate and separate with each other, and each main upper electrode having an outer side face;

a first protective coat, disposed over the resistive film, and covering part of the main upper electrodes;

a pair of barrier layers, disposed on the main upper electrodes, and covering part of the first protective coat;

a second protective coat, disposed on the first protective coat, and covering part of the barrier layers;

a pair of side electrodes, each disposed on the side face of the substrate, the outer side face of the main upper electrode, an outer side face of the barrier layer, and the outer side face of the bottom electrode, for electrically connecting the main upper electrode, the barrier layer, and the bottom electrode; and at least one plated layer, covering the barrier layers, the bottom electrodes, and the side electrodes.

2. The chip resistor according to claim 1, further comprising an inner protective coat, disposed on the resistive film, and covering part of the main upper electrodes, wherein the first protective coat covers the inner protective coat.

3. The chip resistor according to claim 2, wherein a material of the inner protective coat is glass.

4. The chip resistor according to claim 1, wherein the resistive film has two end portions, each main upper electrode further has an inner end portion, and the inner end portion of the main upper electrode overlaps with the end portion of the resistive film.

5. The chip resistor according to claim 1, wherein the resistive film has two end portions, each main upper electrode further has an inner end portion, and the end portions of the resistive film overlap with the inner end portions of the main upper electrodes.

6. The chip resistor according to claim 1, wherein each barrier layer has an outer side face, and the side electrode is further formed on the outer side face of the barrier layer.

7. The chip resistor according to claim 1, wherein a material of the barrier layers is one selected from a group consisting of nickel, palladium, platinum, gold, nickel-chromium, nickel-boron, nickel-phosphor, and combinations thereof.

8. The chip resistor according to claim 1, wherein the material of the barrier layers is the same as that of the plated layer(s).

9. The chip resistor according to claim 1, wherein the material of the first protective coat is the same as that of the second protective coat.

10. The chip resistor according to claim 1, wherein the plated layers comprise a first plated layer and a second plated layer, the first plated layer covers the barrier layers, the bottom electrodes, and the side electrodes, and the second plated layer covers the first plated layer.

11. The chip resistor according to claim 10, wherein the material of the barrier layers is the same as that of the first plated layer.

12. A method for making a chip resistor, comprising:

(a) providing a substrate having a back face, two side faces, and a main face;

(b) forming a pair of bottom electrodes on the back face of the substrate, wherein the bottom electrodes are separate from each other, and each bottom electrode has an outer side face;

(c) forming a resistive film on a middle region of the main face of the substrate;

(d) forming a pair of main upper electrodes on the main face of the substrate, wherein the main upper electrodes are separate from each other, and each main upper electrode has an outer side face;

(e) forming a first protective coat over the resistive film, wherein the first protective coat covers part of the main upper electrodes;

(f) forming a pair of barrier layers on the main upper electrodes, wherein the barrier layers cover part of the first protective coat;

(g) forming a second protective coat on the first protective coat, wherein the second protective coat covers part of the barrier layers;

(h) forming a pair of side electrodes, wherein each side electrode is disposed on the side face of the substrate, the outer side face of the main upper electrode, an outer side face of the barrier layer, and the outer side face of the bottom electrode, for electrically connecting the main upper electrode, the barrier layer, and the bottom electrode; and (i) forming at least one plated layer, for covering the barrier layers, the bottom electrodes, and the side electrodes, thereby forming a chip resistor.

13. The method according to claim 12, wherein the bottom electrodes, the resistive film, and the main upper electrode are formed by printing.

14. The method according to claim 12, wherein after Step (d), the method further comprises a step of forming an inner protective coat on the resistive film, wherein the inner protective coat covers part of the main upper electrodes, and in Step (e), the first protective coat covers the inner protective coat.

15. The method according to claim 12, wherein in Step (c), the resistive film has two end portions, in Step (d), each main upper electrode further has an inner end portion, and Step (d) is performed after Step (c), such that the inner end portion of the main upper electrode overlaps with the end portion of the resistive film.

16. The method according to claim 12, wherein in Step (c), the resistive film has two end portions, in Step (d), each main upper electrode further has an inner end portion, and after Step (b), Step (d) is performed, then Step (c) is performed, such that the end portion of the resistive film overlaps with the inner end portion of the main upper electrode.

17. The method according to claim 12, wherein in Step (f), the barrier layers are formed by electroplating.

18. The method according to claim 12, wherein the material of the barrier layers is one selected from a group consisting of nickel, palladium, platinum, gold, nickel-chromium, nickel-boron, nickel-phosphor, and combinations thereof.

19. The method according to claim 12, wherein the material of the barrier layers is the same as that of the plated layer(s).

20. The method according to claim 12, wherein Step (i) comprises a step of forming a first plated layer to cover the barrier layers, the bottom electrodes, and the side electrodes, and a step of forming a second plated layer to cover the first plated layer.

21. The method according to claim 20, wherein the material of the barrier layers is the same as that of the first plated coat.

* * * * *